US007578074B2

(12) United States Patent
Ridinger

(10) Patent No.: US 7,578,074 B2
(45) Date of Patent: Aug. 25, 2009

(54) SHOE VENTILATION AND SHOCK ABSORPTION MECHANISM

(76) Inventor: Michael R. Ridinger, 106 Shrewsbury St., Boylston, MA (US) 01505

( * ) Notice: Subject to any disclaimer, the term of this patent is extended or adjusted under 35 U.S.C. 154(b) by 32 days.

(21) Appl. No.: 11/162,979

(22) Filed: Sep. 29, 2005

(65) Prior Publication Data

US 2007/0068037 A1 Mar. 29, 2007

(51) Int. Cl.
*A43B 7/06* (2006.01)

(52) U.S. Cl. ..... 36/3 R; 36/3 B

(58) Field of Classification Search ..... 36/3 R, 36/3 B, 29

See application file for complete search history.

(56) References Cited

U.S. PATENT DOCUMENTS

| | | | | |
|---|---|---|---|---|
| 508,034 | A | 11/1893 | Moore | |
| 1,069,001 | A | 7/1913 | Guy | |
| 3,027,659 | A * | 4/1962 | Gianola | 36/3 R |
| 3,973,336 | A | 8/1976 | Ahn | |
| 4,446,634 | A | 5/1984 | Johnson | |
| 5,025,575 | A | 6/1991 | Lakic | |
| 5,341,581 | A | 8/1994 | Huang | |
| 5,515,622 | A * | 5/1996 | Lee | 36/3 R |
| 5,675,914 | A | 10/1997 | Cintron | |
| 5,813,140 | A * | 9/1998 | Obeid | 36/3 R |
| 6,170,173 | B1 | 1/2001 | Caston | |
| 6,247,248 | B1 | 6/2001 | Clark | |
| 6,370,799 | B1 * | 4/2002 | Thatcher | 36/3 B |
| 6,463,679 | B1 * | 10/2002 | Buttigieg | 36/3 B |
| 6,505,420 | B1 | 1/2003 | Litchfield | |
| 2002/0170203 | A1 | 11/2002 | Sanner | |
| 2003/0145488 | A1 * | 8/2003 | Cardarelli | 36/3 R |
| 2004/0221481 | A1 * | 11/2004 | Regen | 36/3 B |
| 2005/0005473 | A1 * | 1/2005 | Oh | 36/29 |
| 2005/0022422 | A1 | 2/2005 | Swigart | |
| 2006/0156575 | A1 * | 7/2006 | Lo | 36/3 B |
| 2007/0094890 | A1 * | 5/2007 | Cho et al. | 36/3 B |

* cited by examiner

*Primary Examiner*—Marie Patterson

(57) ABSTRACT

An article of footwear has ventilation and shock absorption provided by a mechanism which may be constructed within or added to the footwear. A first chamber beneath the heel draws external air through a conduit which includes a one-way valve. As a wearer walks, the heel compresses the first chamber, forcing the air through a special second valve causing directional airflow to a second chamber in a controlled manner thereby absorbing the shock of the heel strike in the same manner a shock absorber functions in an automobile. As weight is transferred from the heel to the ball of the foot, further cushioning is provided by the second chamber. Specifically designed vents connected to the second chamber allow air to be forced into the region of the shoe around the foot. Expansion of the air from these vents affects cooling and drying of the foot through evaporation and convection.

5 Claims, 13 Drawing Sheets

Side View

Side View

First Valve Assembly with First Conduit Connected
(expanded)

First Valve Assembly with First Conduit Connected
(expanded)

Top View
(Down Through Midsole)

Second Valve Assembly
(expanded, without shank)

Complex Single Unit

Complex Single Unit
Cutline G-G
(spring 9B not shown)

Second Valve Assembly
with Cone Valve and Graded Tension Spring

Insole

Alternative Insole

Shoe Liner
Bottom View
(may contain arch support, not shown)

Mechanism Assembled as Shoe Insert

Shoe Insert with Alternative Second Valve

SHOE VENTILATION AND SHOCK ABSORPTION MECHANISM

BACKGROUND OF THE INVENTION

1. Field of the Invention

The invention relates generally to footwear and in particular to an article of footwear which contains a mechanism for enhanced cushioning by absorbing the shock of walking or running and which by pumping air through the footwear provides ventilation for drying and cooling of the foot by evaporation and convection.

2. Description of Related Art

There are two different yet interrelated aspects of the present invention, shock absorption and ventilation. In many cases, prior art has attempted to address the issue of shock absorption by the use of fluid-filled devices in or adjacent to the sole of the footwear. Guy 1069001, Caston, U.S. Pat. No. 6,282,815, Moore 508034 and Swigart 2005/0022422, all deal with shock absorption by the transfer of fluid, Several other patents; Lakic U.S. Pat. No. 5,025,575, Huang U.S. Pat. No. 5,341,581, Swigart 2005/0022422 and others, have internal valves to control the direction of airflow. Litchfield U.S. Pat. No. 6,505,420 provides for flow rate control. Johnson U.S. Pat. No. 4,446,634 controls the rate of flow and provides for adjustment.

In the prior art, systems for providing ventilation in footwear have attempted to address the issue of cooling and drying by removing excessive heat and moisture with a constant air exchange. Clark U.S. Pat. No. 6,247,248, Sanner 2002/0170203, Cintron U.S. Pat. No. 5,675,914 and others, allow for airflow. Guy 1069001, Swigart 2005/0022422 and Ahn U.S. Pat. No. 3,973,336 provide an air snorkel to overcome some of the issues surrounding particulate introduction.

An exhaustive search of prior art shows that there are many examples of footwear or shoe inserts that attempt to address the issue of shock absorption and ventilation in one manner or another. There are deficiencies found within prior art such as; problems with clogging of the intake conduits and valves by particulate matter introduced either externally or within the shoe cavity, moisture accumulation within the air channels and cavities and/or lack of proper fresh air flow, and a lack of control of the rate of air/fluid transfer. In cases where the air flow was restricted, it was through a simple constriction of the channel and there was no variable control of the rate of air flow. In the cases where there was control of the rate of air flow, the control only involved a restricted pressure release and could not absorb the short duration, high pressure spikes of the heel impact.

The present invention incorporates additional means to improve the absorption of shock by controlled pressure release and the improved ability to absorb high impact heel strikes. In addition the present invention provides for improved air flow, prevention of contamination of the mechanism and simplicity of manufacturing. The intent to achieve improved cushioning and comfort in footwear is thereby achieved.

SUMMARY OF THE PREFERRED EMBODIMENT OF THE INVENTION

To achieve the purposes of the present invention as embodied and described herein, the article of footwear of the present invention comprises a shoe upper and a sole which are stitched or bonded together to form a cavity to comfortably accept the foot of a wearer (hereinafter called the shoe cavity). The sole may be made of an outsole made up of an abrasion resistant material, a midsole made up of an elastomeric cushioning material and an insole. The footwear may also contain a sock liner made of an elastomeric, non-permeable cushioning material which resides upon and may be attached to the insole.

The mechanism is made up of a first conduit, a first valve, a first chamber, a second conduit, a second valve, a third conduit, a second chamber and any number of fourth conduits terminated by holes ending in the shoe cavity.

The first conduit fluidly connects from the external part of the shoe at the heel near the ankle to conduct air into the system and terminates at the inlet to the first valve. The top of the first conduit may have cloth, perforations or some other permeable material to effect filtering of the incoming air and prevent inclusion of particulate matter.

The first valve may reside in the midsole at the rear of the first chamber and exhausts into the first chamber. The first valve may be a flap valve and provides one-way air flow from the first conduit to the first chamber. The structure for forming the inlet to the first valve which accepts the terminus of the first conduit may be constructed externally to form a first valve assembly. This first valve assembly could then be inserted or formed within the sole.

The bottom portion of the first chamber may be formed as a depression within the midsole. The top portion of the first chambers may be formed by attaching a separate elastomeric material above and completely covering the depressed areas in the midsole, or may be formed by the insole, or may be formed by attaching the sock liner made of a separate elastomeric material above an opening in the insole that corresponds to the area of the depression beneath the heel. The first chamber absorbs a portion of the shock of a heel strike and provides the majority of the air pumping action within the mechanism.

The second conduit fluidly connects from the first chamber and terminates at the inlet to the second valve.

The second valve has two functions. The first function is to permit one-way air flow from the first chamber to the second chamber. The second function is to control the rate of said air flow in an adjustable manner so as to compensate for the weight and walking or running characteristics of the wearer.

A third conduit fluidly connects from the outlet of the second valve to the second chamber.

The second conduit, second valve and third conduit may reside within the midsole and extend from the heel region at the front of the first chamber to the second chamber at the metatarsal region and may run beside or beneath a shank within the midsole. Alternately these three pieces may be constructed such that they can replace the shank. In addition, these three pieces and/or the shank could be combined with a heel shaped rigid material and the first valve assembly to form a complex single unit which can be placed prior to forming the midsole.

The top portion of the second chamber may be a flat or shallow chamber formed upward into the elastomeric material of the sock liner beneath the metatarsal region of the wearer's foot. The bottom portion of the second chamber is formed by attaching and/or sealing the sock liner to the insole.

The fourth conduits fluidly connect from the second chamber and may terminate at areas near the forefoot just before and between the wearer's toes. The fourth conduits would be terminated by small holes through the sock liner to allow fluid communication between the second chamber and the shoe cavity. The size of these terminating holes would determine the rate the air was forced from the second chamber to within the shoe cavity.

Alternatively the entire mechanism may be constructed as part of a shoe insert which is added to the footwear as a separate piece.

BRIEF DESCRIPTION OF THE DRAWINGS

The included drawings which, being exaggerated in dimension for the purpose of clarity, form a part of the specification and illustrate various embodiments of the present invention. These drawings, together with the description, serve to explain the principles of the invention.

In the following drawings.

DETAILED DESCRIPTION OF THE INVENTION

The following discussion and accompanying figures disclose a mechanism which is made of several elements when joined in fluid communication and assembled within the footwear provide shock absorption and ventilation to the foot of a wearer. The shock absorption is accomplished by the compression and release of air from a chamber beneath the heel and metatarsal regions of the wearer's foot. The ventilation is accomplished by the pumping action of the chambers which provide a continuous supply of fresh air which moves through the shoe cavity thereby drying and cooling the foot of the wearer. This mechanism is applicable to types of footwear including running or walking shoes, athletic wear, hiking boots, dress shoes, loafers, work boots and many other types of footwear.

Figure 1:
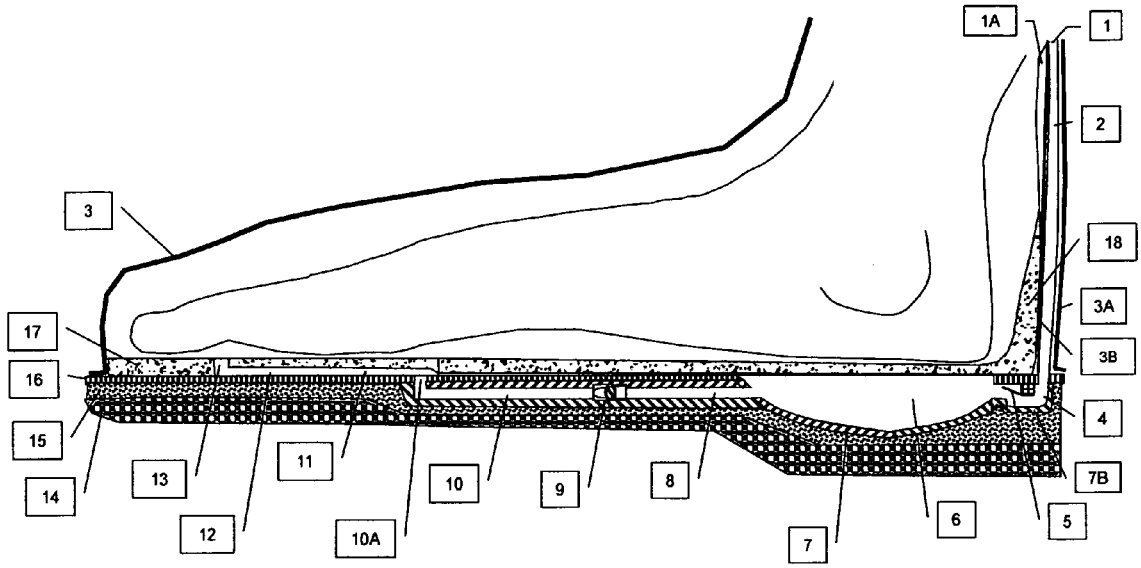
FIG. 1 is a side view of the entire footwear.

An article of footwear as shown in FIG. 1 includes an upper 3 and a sole that are stitched or adhesively bonded together to form a shoe cavity to comfortably accept the foot of a wearer. The upper 3 has the normal configuration for footwear and may be made of a number of different materials including textiles, foam or leather. The upper typically would have an outer portion 3A and an inner portion 3B at the region of the heel to provide additional stiffness in that region. The sole may be made in a number of layers, typically made of an insole 16, a midsole 15 and an outsole 14. The insole 16 which may be made of a relatively stiff material would provide rigidity and stability to the entire footwear assembly. The midsole 15 which may be made of an elastomeric material such as blow molded urethane or similar material, due to its properties would provide some shock absorption and cushioning during walking. The outsole 14 which would typically be made of an abrasion resistant material, would be in contact with the ground.

There are several variations of the present invention. The first and preferred embodiment has portions of the mechanism contained within the upper heel, midsole and sock liner. Air is drawn into the mechanism through the filter device 1 and down the first conduit 2 which may reside between the outer 3A and inner 3B heel portion of the upper. The air is then drawn through the first valve 5 and into the first chamber 6.

The action of the mechanism is initiated as the heel of footwear on the wearer's foot strikes the ground. The air within the first chamber 6 is compressed and some of the shock of the heel strike is absorbed. The first valve 5 prevents air from returning into the first conduit 2. As the air in the first chamber 6 is compressed, the pressure in the first chamber 6 rises. The second conduit 8 being in fluid connection to the inlets of the second valve, made up of holes 9E and 9D, applies the pressure within the first chamber 6 to the flap 9C of the second valve assembly 9. Since the flap 9C is an elastic material with properties of springiness and stiffness, the flap remains closed until the pressure rises adequately to overcome the stiffness of the flap 9C. The flap is covering two holes but since the flap covering the second hole 9E, nearest the flap hinge, has a spring 9B over it and hence greater compression against it, the first hole furthest from the hinge opens first. The opening of the first hole allows some of the air to escape the first chamber 6. As the heel strike initiates, the pressure in the first chamber 6 rises until the flap over the first hole opens. Since the first hole 9D is small, the air flow through it is restricted and the pressure will continue to rise until it overcomes the compression due to the spring 9B over the second hole 9E. At this point more air is released from the first chamber 6. Since the second hole 9E is much larger than the first hole 9D, the airflow is greater. As the air flows out of the first chamber through both the large and small holes, the pressure will begin to drop. At the point where the pressure drops below the level where the pressure equals the compressive forces of the spring 9B and flap 9C, the section of the flap 9C above the second hole 9E closes and the air release is lowered to the level controlled by the first hole size. As the compression of the heel strike pushes the top portion of the first chamber 6 to the bottom of the depressed region, the compression of the air stops and the second valve completely closes. The compression and release of air within the chambers acts in a manner very similar to that of a shock absorber in an automobile. In particular, the two stage release of the second valve allows the high impact of the initial heel strike to be absorbed and released through the second hole 9E, then the remainder of the heel strike to be dissipated more slowly through the first hole 9D. Since a screw 9A is in contact with the spring 9B above the second hole 9E of the second valve assembly 9, the pressure at which the high impact forces are released, can be adjusted. This screw may protrude to an opening in the side of the midsole. This opening may have a plug at the end to keep out dirt and debris. To adjust the screw, the plug would be removed. This adjustment is useful to compensate for the weight and walking or running characteristics of the wearer. The sizing of the two holes, the flap stiffness and spring tension are all chosen by the footwear designer to determine the characteristics of the pressure release afforded by the present invention.

The center of the depression in the first chamber 6 may have a pocket deeper than the depression wherein a spring resides (not shown). This spring would help rapidly expand the first chamber once compressive forces of the heel are removed. When the first chamber is fully compressed by the heel, the spring is depressed within this additional recess of the first chamber. This spring may be topped with a stiffer elastomeric material of an area less than the area of the first chamber, to distribute load forces.

The preferred embodiment of the present invention has the top portion of the depression of the first chamber, topped by a hole 6A in the insole the same area as the depression. This hole is then covered by the sock liner which is bonded to the insole which is bonded to the midsole.

Figure 3:
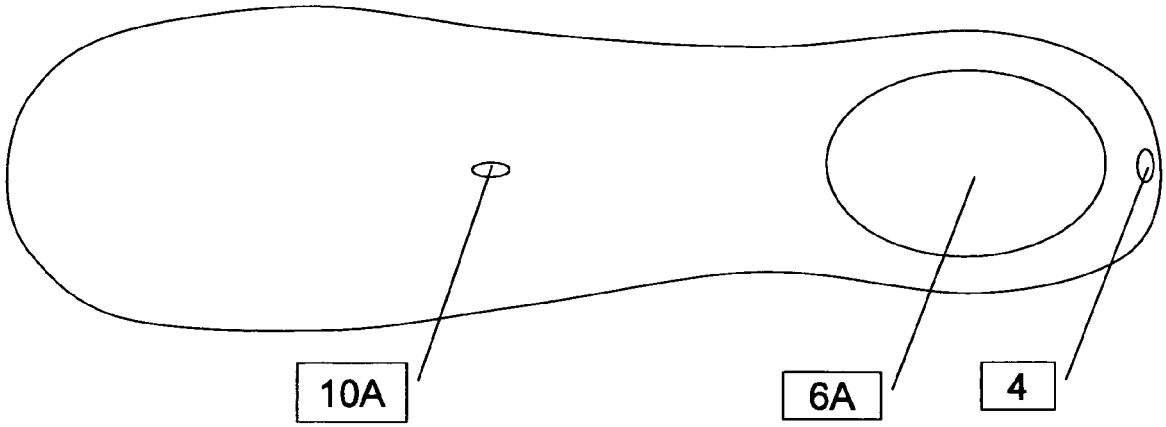
FIG. 3 is top view of the insole.
Figure 3A:
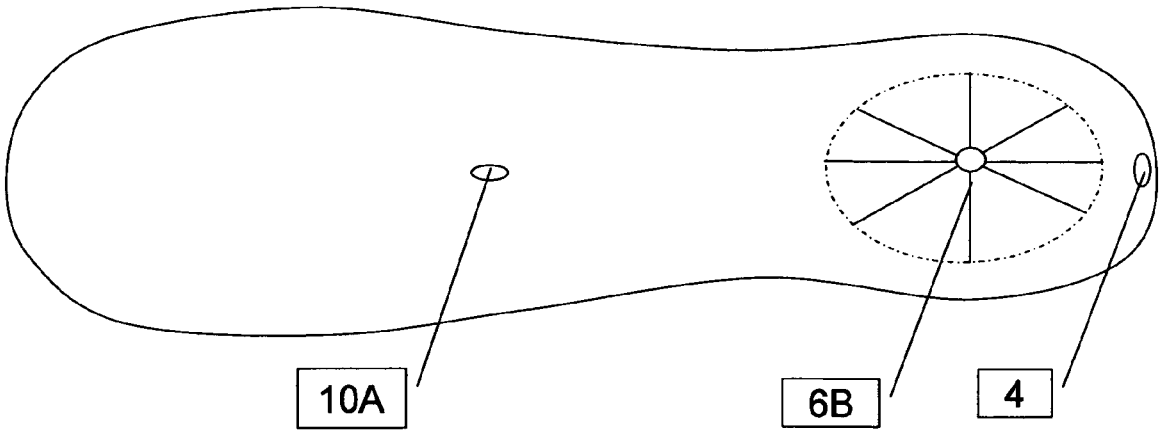
FIG. 3A is an alternative version of the insole.
Figure 4:
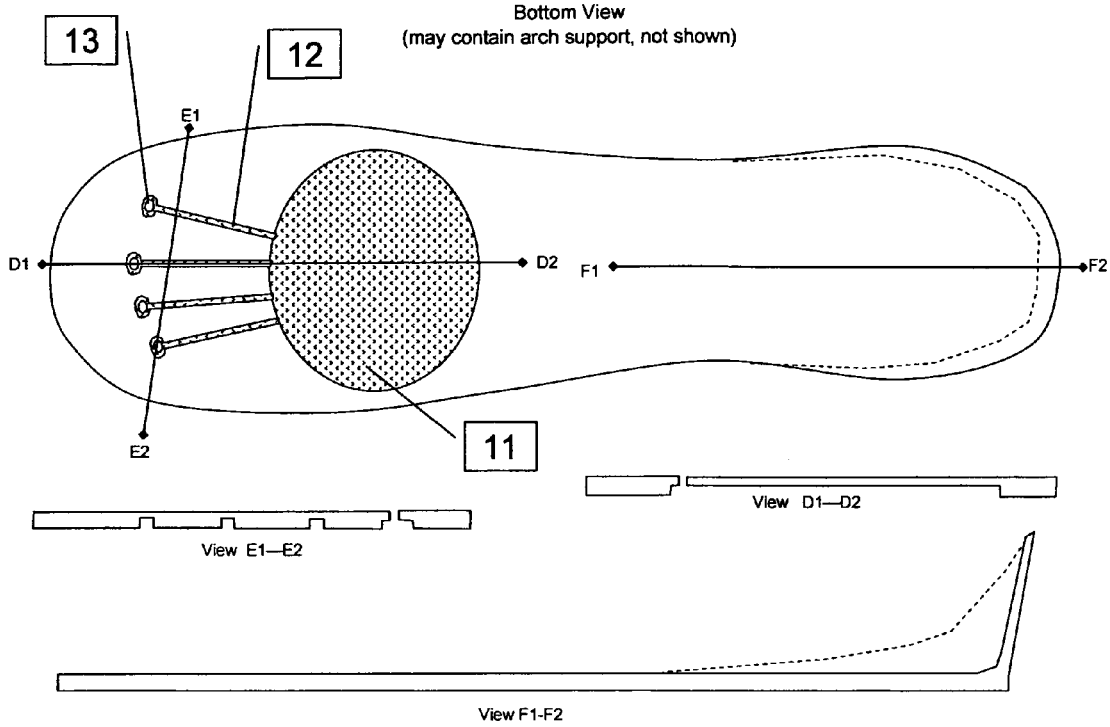
FIG. 4 is a bottom view of the shoe liner with several cutline views.

An alternative to the hole in the insole would be to form a series of slices through the insole corresponding to the depression's area, in the form of a star with the center removed 6B as shown in FIG. 3A. If the top of the first chamber depression in the midsole were covered by an elastomeric material bonded to seal the depression, then as the wearer's heel pressed down against the sock liner which pressed down against this star formation, then the tangs in the insole formed by the star formation would press down against the top cover of the first chamber depression. This alternative configuration of the first chamber would prevent the wearer's heel from moving as far down within the midsole while still affecting shock absorption and the pumping action required for ventilation.

The top portion of the first chamber depression may also be formed by the insole, which would flex downward to provide pumping and absorb shock, although with greater stiffness. As can be seen by one skilled in the art, choosing the desired configuration for the top portion of the first chamber gives the footwear designer control over stiffness, stability and cushioning for the heel region.

An alternative to using a screw, spring and flap valve within the second valve assembly 9 to effect a two stage pressure release, would be to use a flap 9C of varying thickness, where the thicker end covers the second hole 9E. The thicker portion of the flap 9C would be correspondingly stiffer and would require greater pressure to open the valve flap portion over the second hole 9E. Although this alternative would have an added benefit of reduced complexity and hence reduced cost of manufacturing, it would remove the adjustment capability. This reduced cost may be desirable for a less expensive general purpose shoe.

Figure 2:
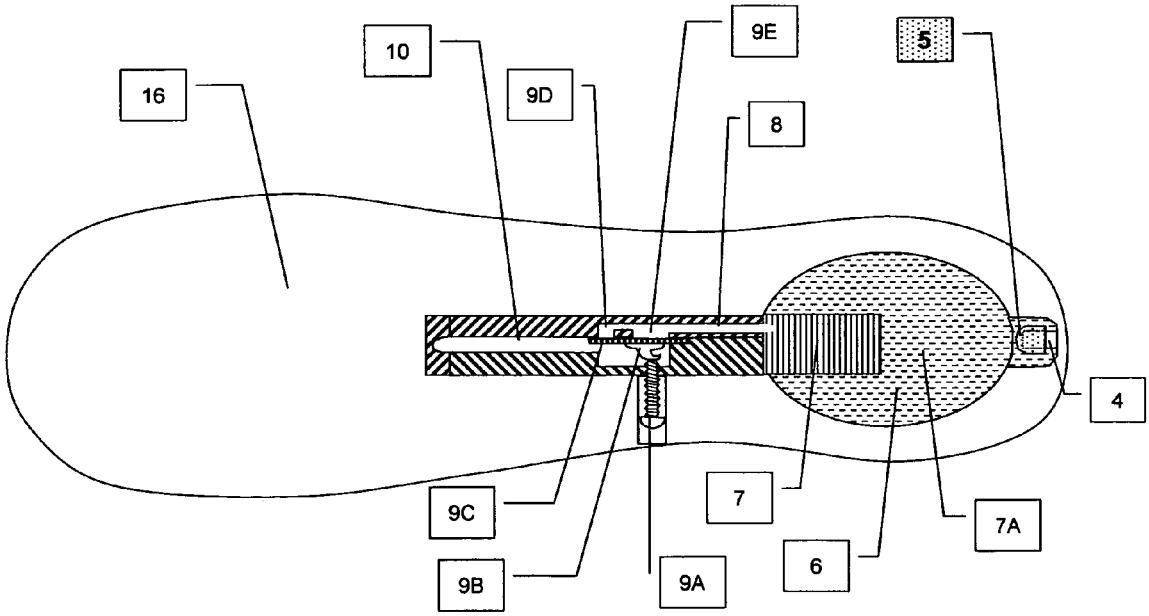
FIG. 2 is a top view looking down through the midsole.
Figure 2A:
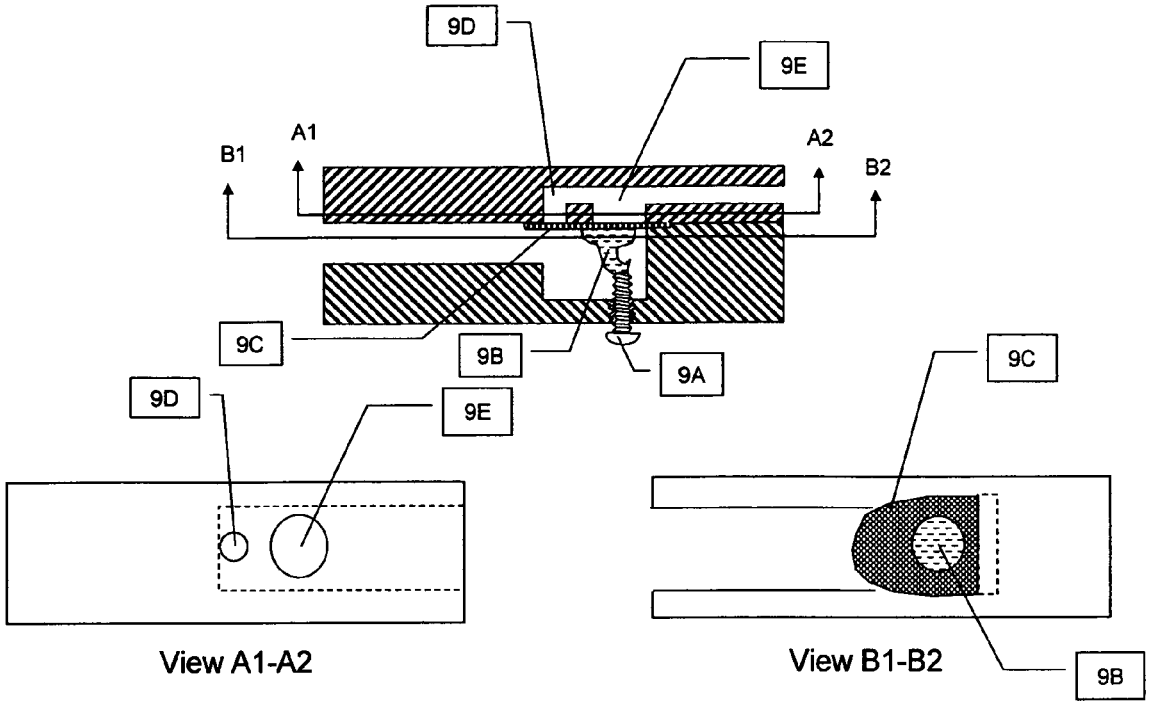
FIG. 2A is an expanded view of the second valve assembly with two side view cutlines.
Figure 2B:
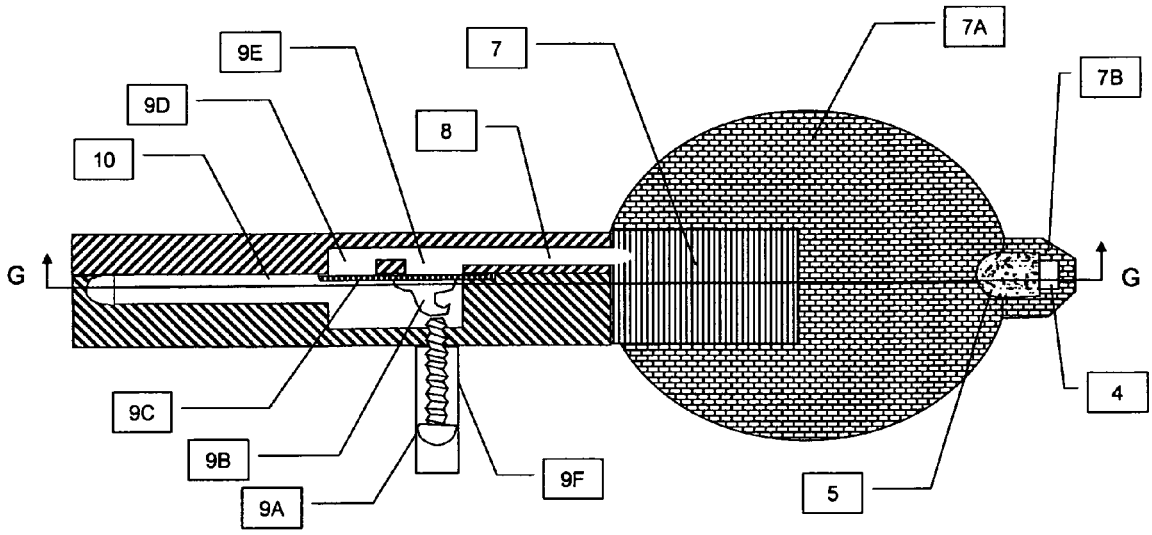
FIG. 2B is a top view of the complex single unit.
Figure 2C:
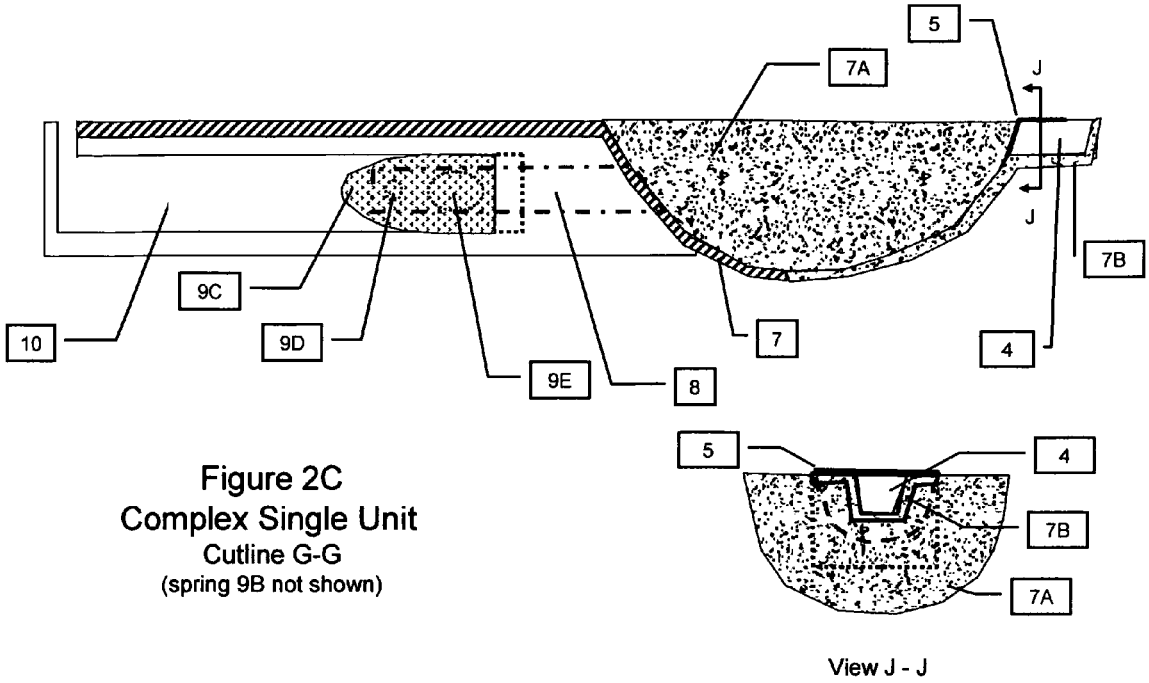
FIG. 2C is a side view cutline of the complex single unit.
Figure 2D:
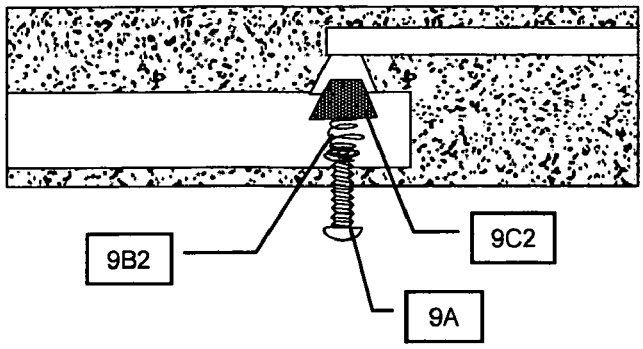
FIG. 2D is an alternative second valve assembly.

Another alternative to using a screw, spring and flap valve within the second valve assembly 9 to effect a two stage pressure release would be to use a screw 9A, graduated tension spring 9B2 and ball or cone valve 9C2, as shown in FIG. 2D. The ball or cone would rest in a conically shaped single opening fluidly connected to the end of the second conduit. As pressure of the heel strike increased, the valve would open more releasing more of the air. The conical shape of the opening would effect restriction of the air flow. This would have the benefit of a two stage pressure release if the spring had a graded tension such that the more the spring were compressed the greater the tension.

The movement of air caused by the one way action of the first valve 5, the compression of the first chamber 6 and the one way action of the second valve assembly 9, provides for a major portion of the pumping action used to supply the ventilation aspect of the mechanism. As the air is expelled from the second valve 9 through the third conduit 10, through a hole in the insole 10A and into the second chamber 11, the second chamber will inflate. As the foot of the wearer rolls off the heel onto the metatarsal region of the foot, the second chamber 11 is compressed, the pressure rises and the impact on the metatarsal region of the foot is cushioned. Since the forces are less as the foot impact comes to the metatarsal region, less cushioning is required. The fourth conduits 12 conduct the air flow from the second chamber 11 to the exit holes 13 which may open through the sock liner to the shoe cavity near the wearer's toes. The size of these holes 13 control the rate of air leaving the second chamber 11 and hence control the rate the second chamber collapses and cushions the forces applied to the metatarsal region of the foot. The size of the second chamber 11 and the terminating holes 13 can be chosen to determine the degree of cushioning under the metatarsal area of the foot. The second chamber may even be reduced in size to act only as a distribution point for the airflow into the fourth conduits 12. The fourth conduits 12 may be any number and may terminate within any region of the shoe cavity.

The air leaving the mechanism through the small holes 13 expands around the foot within the shoe cavity, cooling and drying the foot through evaporation and convection. The air may leave the footwear by movement up around the foot to the top of the shoe or through ventilation holes in the upper provided for that purpose.

Figure 1A:
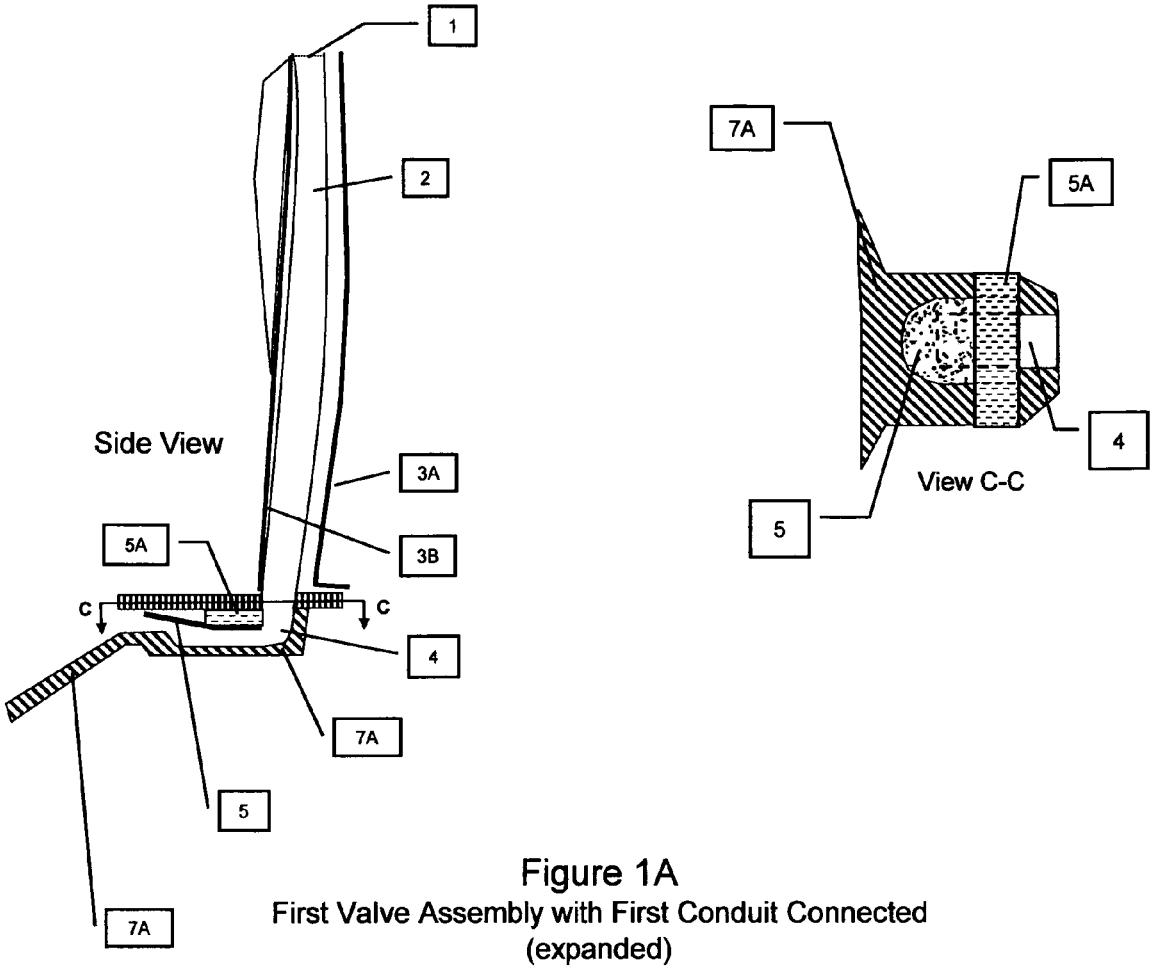
FIG. 1A is an expanded side and top view of the first valve assembly with the first conduit.
Figure 1B:
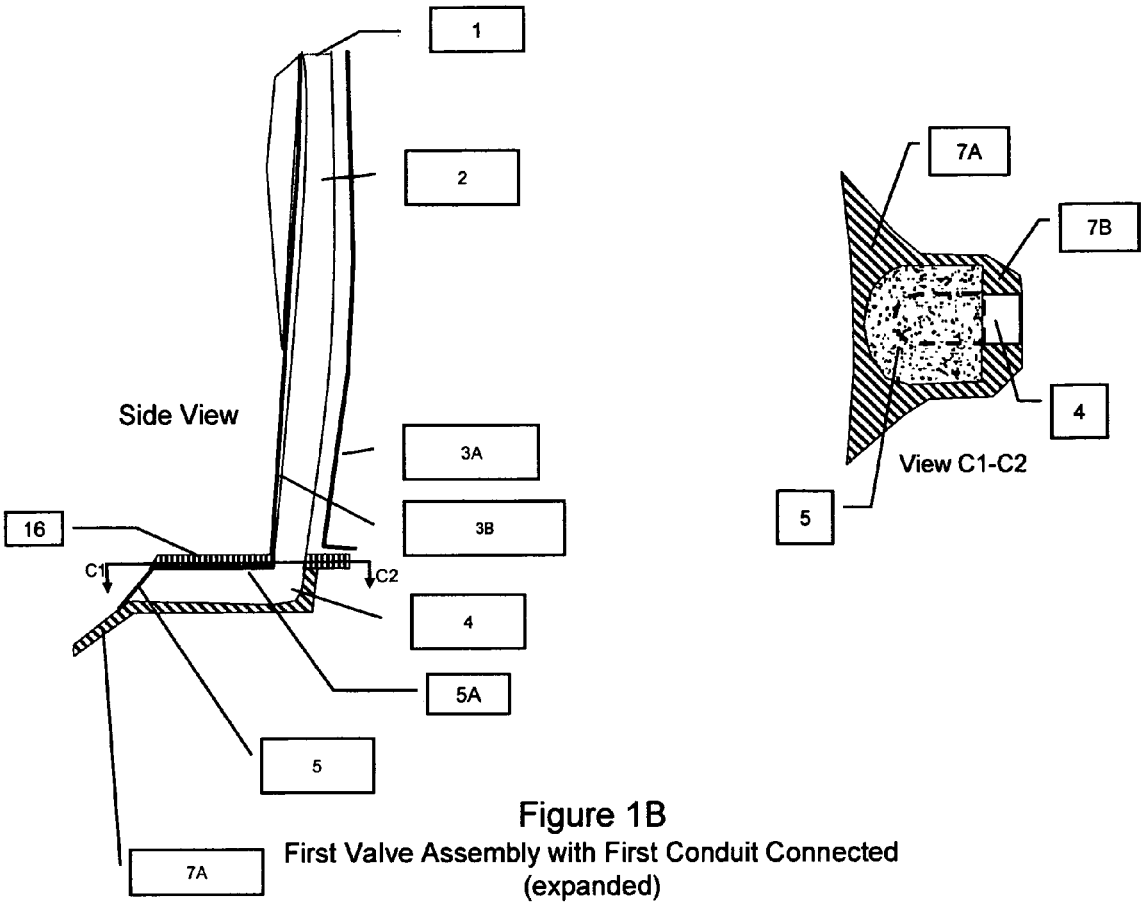
FIG. 1B is an alternative first valve assembly.

As known by one skilled in the art, a shank is typically an important part of constructing footwear to provide adequate rigidity to a sole constructed of elastomeric cushioning material. It then follows that the mechanism may be formed as part of or to replace the shank. It can then be seen that forming the second conduit 8, second valve 9 (ABCDE) and third conduit 10 as a second valve assembly 9 and placing it prior to molding the midsole, would help simplify construction of the footwear. In addition, a rigid material formed as a concave or similarly shaped shell 7A could be attached to the first valve structure 7B which forms the first valve inlet 4 and with the first valve flap 5 bonded to the terminus of the inlet 4 nearest the concave shell 7A would form the first valve assembly as shown in FIG. 1A and alternatively in FIG. 1B. This first valve assembly being attached and fluidly connected to the second valve assembly 9 would form a complex single unit as shown in FIG. 2B. This complex single unit of FIG. 2B could be placed prior to molding the midsole and hence further simplify construction of the footwear over separately placing the individual parts of the mechanism.

Figure 5:
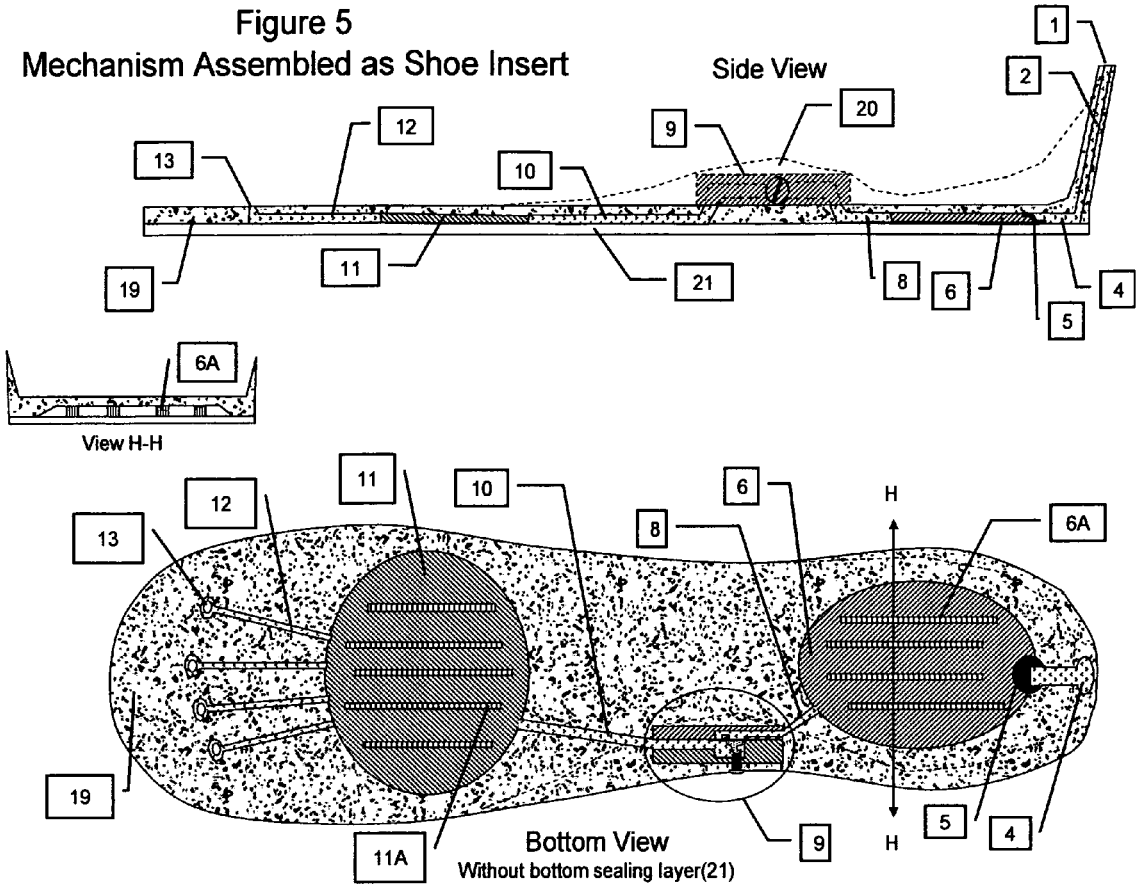
FIG. 5 is a top and side view of the mechanism incorporated within a shoe insert.
Figure 5A:
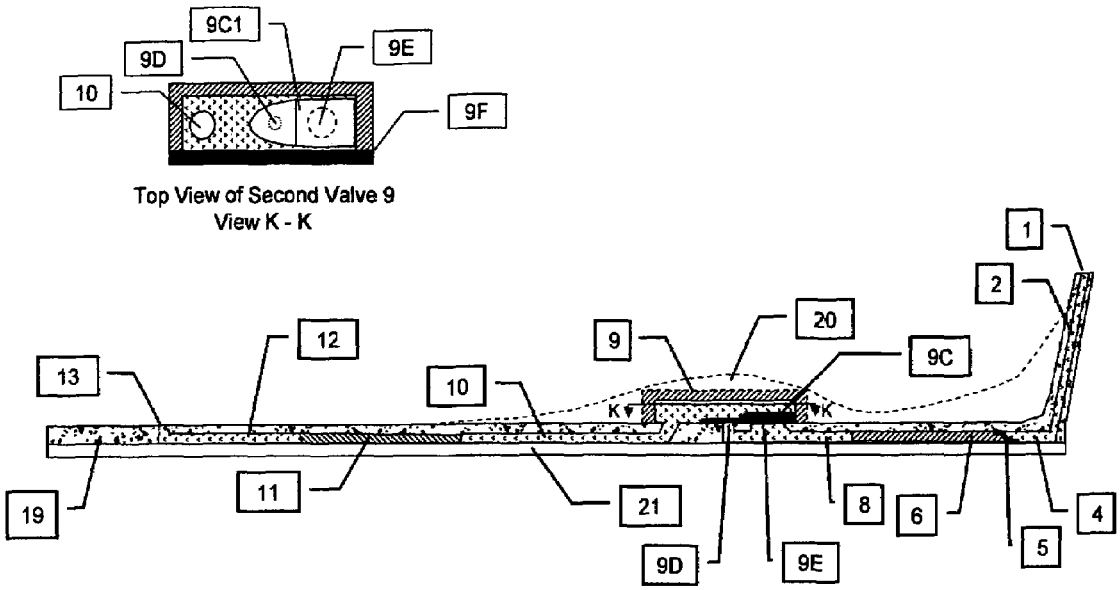
FIG. 5A is the mechanism incorporated within a shoe insert with an alternative second valve.

Another embodiment of the present invention would be to construct the entire mechanism as part of a shoe insert to be placed within an article of footwear as a separate piece. FIG. 5 shows the mechanism assembled as part of a shoe insert 19. (note: numbering remains the same as the previous sections except in differences as needed for the shoe insert) The first conduit 2 would be formed within the heel riser and would terminate at the first valve inlet 4. The first valve inlet 4, first chamber 6, second conduit 8, third conduit 10, second chamber 11 and fourth conduits 12 would be formed as recesses upward within the bottom of the shoe insert. The first chamber 6 and second chamber 11 would have heel ridges 6A and metatarsal ridges 11A. These ridges would collapse when pressure was applied to either the first chamber 6 or second chamber 11. The first valve 5 would be formed by bonding a flap of elastomeric material over the end of first valve inlet recess 4 nearest the first conduit 2 leaving the end within the first chamber 6 free to open and close. The bottom of the first valve inlet 4, the first chamber 6 the second conduit 8, the third conduit 10, the second chamber 11 and the fourth conduits 12 would be formed by bonding an elastomeric material 21 over the entire bottom layer of the shoe insert. The holes 13 terminating the fourth conduits 12 would penetrate from the bottom of the shoe insert within the fourth conduit recesses to the top of the shoe insert 19. The second valve assembly 9 would be formed in a cavity within the arch support 20 on the top of the shoe liner and positioned to be in fluid connection with the second conduit 8 and third conduit 10. This shoe insert, with the integrated mechanism, would function in exactly the same manner as the embodiment of the present invention as described in the previous sections. Due to the nature of a shoe insert, it may be preferable to use the stepped flap for the second valve as described in claim 7 (subset b) and shown in FIG. 5A. The two stage pressure release is accomplished by taking advantage of the difference in flexibility of the two parts of the flap. In this case the flap 9C1 would cover the two holes 9D and 9E directly formed as part of the second conduit within the bottom of the shoe insert. The second valve 9 would be in a recess in the side of the arch support 20 which was in fluid connection to the outlet of the second conduit 8 and the inlet to the third conduit 10. The flap 9C1 would be formed by bonding the stepped elastomeric material at the truncated end beyond the larger hole 9E. The recess would be closed by bonding an elastomeric material 9F over the opening at the side of the arch support. This alternative would be easy to manufacture requiring few steps to assemble the device.

Another useful feature of the present invention is to provide for warming and drying of a wearer's foot. If a tube were run within a person's clothing, opening at perhaps the neck or waist and running down to the ankle, the end of the tube could be plugged into the inlet 1 of the first conduit 2. This tube could be part of a specially constructed body stocking. When a wearer walked, the pumping action of the mechanism would draw in fresh dry air and warm it as it flowed within the tube down the wearer's body. This warmed air would be moved around the wearer's foot by the action of the mechanism thereby warming and drying the foot. Since extremities are the first to get cold in winter, this feature would have tremendous value in helping keep a wearer's feet warm. If the tube were so constructed such that it also circulated through a wearer's glove, then both the hands and feet would be warmed by the pumping action of the mechanism.

In summary, the present invention as described herein presents a mechanism that can easily be assembled within footwear and provides for improved shock absorption and cooling and drying of the wearer's foot through convection and evaporation. When used in conjunction with a specially constructed body stocking, the mechanism provides for warming and drying of the wearer's feet. There are many variations possible for the configuration and placement of the valves, chambers and conduits plus application for the pumping action. The present embodiment of the invention shows a typical application which does not detract from other embodiments of the present invention.

What is claimed is:

1. An article footwear having an improved cushioning and cooling means comprising;

a shoe with an upper portion and a sole bonded or stitched together which form a chamber for the wearers foot;

the sole comprises an elastomeric insole adjacent to the wearer's foot and is topped by a shoe liner, a midsole made of an elastomeric material and an outsole made of an abrasion resistant material;

the midsole has a heel region and forefoot region;

the heel region of the midsole contains a bladder formed by a hollow in the midsole heel and bonding of an elastomeric material above the hollow;

the bladder in the midsole heel is connected to the external air through a first valve and first conduit;

the bladder in the midsole is connected through the midsole forefoot region to the area of said chamber beneath the wearer's toes by a two stage adjustable second valve and a second conduit.

2. The article of footwear of claim 1 whereby the bladder, conduits and valves are formed separately as parts of the midsole or formed as a complete mechanism which is molded as part of the midsole.

3. The article of footwear of claim 1 wherein the two stage adjustable second valve accomplishes a two stage pressure release by using a flap made of an elastomeric material covering two different sized holes fluidly connected to an inlet of said two stage adjustable second valve; whereby said first hole furthest from a truncated and attached end of said flap, is smaller and said second hole closest to the truncated and attached end of said flap is larger; wherein said holes are sized to restrict the flow of air through said two stage adjustable second valve thereby determining the rate of air flow through each hole.

4. The article of footwear of claim 3 wherein said two stage adjustable second valve is adjusted by a spring loaded screw to control the rate of airflow; said spring loaded screw is placed above the region of the flap nearest the attached end of the flap and covering the larger hole fluidly connected to the inlet of said two stage adjustable second valve; said screw portion of said two stage adjustable second valve assembly may protrude to the edge of the sidewall of the sole to allow access for the adjustment of the airflow rate; said spring is a rubberized ball or drop of material with elastic properties or a metal spring to provide a spring load between said two stage adjustable second valve flap and said screw; said two stage pressure release is accomplished by the flexibility of said flap and said spring loaded screw.

5. The article of footwear of claim 1 wherein said two stage pressure release is accomplished by the differences in flexibility and stiffness of said flap due to a differences in thickness of said flap over each hole.

* * * * *